United States Patent [19]

Bogaert

[11] 3,960,089

[45] June 1, 1976

[54] DEVICE FOR UNWINDING THREAD AND BOBBIN USED THEREWITH

[75] Inventor: Pieter Joseph Bogaert, Sint-Niklaas, Belgium

[73] Assignee: Manta, Waasmunster, Belgium

[22] Filed: Sept. 6, 1974

[21] Appl. No.: 503,572

[30] Foreign Application Priority Data

Sept. 7, 1973 Belgium ..... 804596

[52] U.S. Cl. ..... 112/228; 242/131; 242/137

[51] Int. Cl.[2] ..... D05B 57/14; B65H 49/18

[58] Field of Search ..... 112/228–231; 242/137, 138, 131, 131.1, 134, 129.8, 156

[56] References Cited

UNITED STATES PATENTS

| | | | |
|---|---|---|---|
| 2,509,333 | 5/1950 | Burlingame | 242/131 |
| 2,555,658 | 6/1951 | Ritter | 112/229 |
| 2,690,726 | 10/1954 | Wener | 242/156 X |
| 3,716,204 | 2/1973 | Klingbeil | 242/129.8 |

FOREIGN PATENTS OR APPLICATIONS

| | | | |
|---|---|---|---|
| 84,241 | 1/1958 | Denmark | 242/129.8 |

*Primary Examiner*—H. Hampton Hunter
*Attorney, Agent, or Firm*—Sughrue, Rothwell, Mion, Zinn & Macpeak

[57] ABSTRACT

There is described a device for unwindng thread by means of which the bobbin can easily rotate about the pin when a pull is exerted on the thread, but which stops the bobbin very rapidly when said pull on the thread stops, in such a way that the thread is thus no more unwound. The cross-section of the pin when considered at a right angle to the lenthwise direction thereof and the inner cross-section of the bobbin sleeve, also as considered at a right angle to the lengthwise direction thereof, at least where the sleeve and the pin engage one another, are so selected as to make possible a sidewise movement of the bobbin relating to the pin and at least where the sleeve and the pin engage one another, the one cross-section is circular while the other cross-section has a shape which is substantially different from a circular shape.

4 Claims, 3 Drawing Figures

DEVICE FOR UNWINDING THREAD AND BOBBIN USED THEREWITH

This invention relates to a device for unwinding thread, which comprises a bobbin or spool with a sleeve about which the thread is wound and a pin over which the bobbin is rotatingly arranged with the sleeve thereof, the thread being pulled sidewise relative to the bobbin and thus being unwound sidewise with a rotation of said bobbin.

In the known devices of this kind, the pin cross-section as well as the inner cross-section of the bobbin sleeve are round. There is relatively little difference between both these cross-sections because the bobbin to the exception of the rotation about its axis, has to move as little as possible relative to the pin by the unwinding of the thread. In this way, the sleeve diameter can moreover be retained as small as possible. For a given bobbin diameter which is limited when the bobbin is to be arranged inside a container such as a spool case, the amount of thread on the bobbin is then the largest one. By the unwinding of the thread, the bobbin rotates very easily around the pin. However, with a sudden stoppage of the pull on the thread, the bobbin does not stop immediately in said known device but still rotates a bit further about the pin. Since during this further rotation, no pull is exerted on the thread, various loose turns are formed about that thread still firmly wound on the bobbin sleeve. There is then a great danger that such turns will get tangled together or wedged about the pin. The loosened turns can even particularly at the beginning of the bobbin unwinding, pass over the bobbin flanges when provided.

It has well been already tried to obviate such drawbacks, by arranging small magnets facing the bobbin on a part which is made fast to the pin. This does however require the use of metal bobbins. Said metal bobbins are slowed down by the small magnets. it is also known to brake the bobbin by means of a spring. The braking also occurs during the unwinding proper, in such a way that by the unwinding, a larger force has thus to be exerted on the thread, which can cause too much thread stretching.

This invention has for object to obviate these drawbacks and to provide a device an unwinding thread by means of which the bobbin can easily rotate about the pin when a pull is exerted on the thread, but which stops the bobbin very rapidly when said pull on the thread stops, in such a way that the thread is thus no more unwound.

For this purpose, the cross-section of the pin when considered at a right angle to the lengthwise direction thereof and the inner cross-section of the bobbin sleeve, also as considered at a right angle to the lengthwise direction thereof, at least where the sleeve and the pin engage one another, are so selected as to make possible a sidewise movement of the bobbin relating to the pin and at least where the sleeve and the pin engage one another, the one cross-section is circular while the other cross-section has a shape which is substantially different from a circular shape.

It has indeed been surprisingly determined that when a pull is exerted on the thread, the bobbin sleeve lies at least locally with the inner surface thereof against the pin and rotates without any difficulty about said pin, while when the pull on the thread stops, and consequently the force exerted on the bobbin suddenly ends, said bobbin will swing relative to the pin and due to such swinging, said bobbin will stand still nearly immediately. When the pull stops, the energy of the rotating bobbin is not used to overcome the friction and further rotate the bobbin about the pin, but such energy is rather converted into impacts by means of which said energy is rapidly spent.

In a particular embodiment of the invention, the pin cross-section where said pin engages the bobbin sleeve, is circular, while the sleeve inner cross-section has a shape which is substantially different from a circular shape.

With this embodiment, a known device for unwinding thread can easily be converted into a device according to the invention. It is only necessary to replace the bobbin.

In a particular embodiment, that cross-section substantially different from a circular shape is polygonal.

Preferably, said non-circular cross-section is triangular.

Among all of the polygons, the triangle is always the most different from a circular shape, in such a way that with this embodiment, the slowing down of the bobbin is the largest when a pull is no more exerted on the thread.

Usefully, the angles of the triangular cross-section are rounded.

With this embodiment, the advantages of a circular cross-section are obtained but the outer diameter of the sleeve can be made smaller than when the angles are not rounded, in such a way that for a given bobbin diameter, a larger amount of thread can be located thereon.

In an advantageous embodiment of the invention, the pin has over the whole length thereof the same cross-section, while the sleeve inner cross-section is also the same over the whole length thereof.

In an useful embodiment, the pin is horizontal.

In a preferred embodiment, the device is part of a sewing machine.

The invention also relates to a bobbin or spool which is particularly to be used with the device according to any one of the preceding embodiments, in which the pin cross-section is circular but the inner cross-section of the bobbin sleeve is substantially different from a circular shape.

Other details and features of the invention will stand out from the description given below by way of non limitative example and with reference to the accompanying drawings, in which.

In the various figures, identical references pertain to similar elements.

Figure 1:
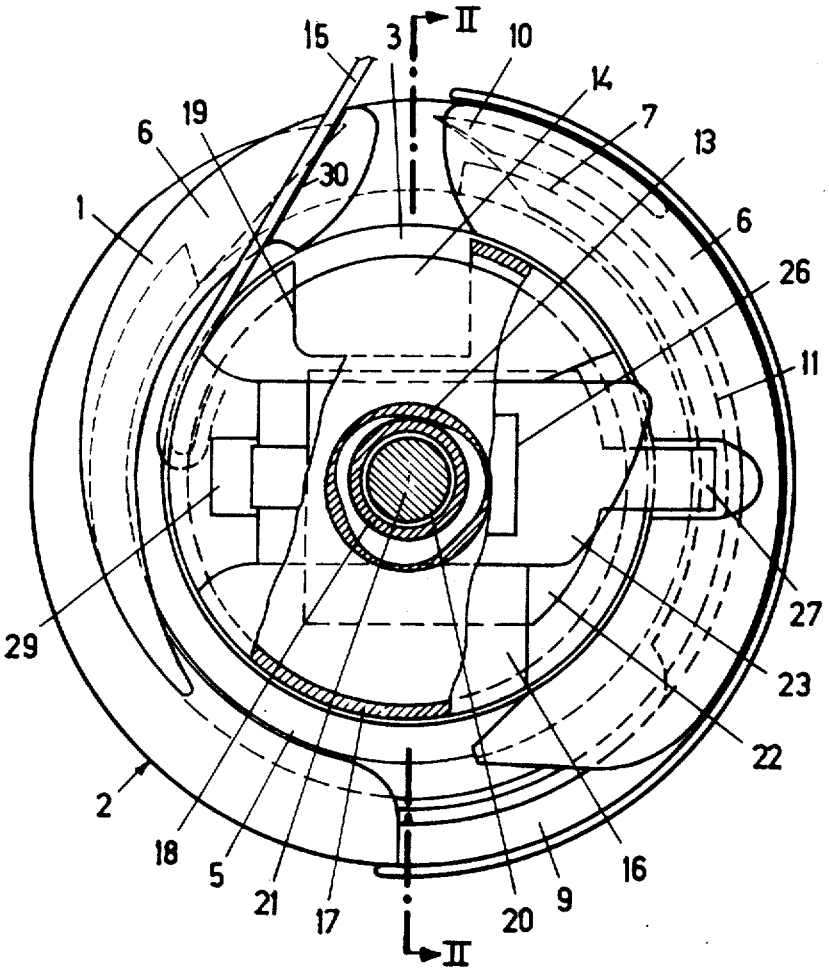
FIG. 1 is a side elevation view of a device for unwinding thread according to the invention, part of the bottom of the bobbin or spool case being broken away.

The device for unwinding thread shown in the drawings is part of a sewing machine with rotary hook. Said rotary hook comprises a basket 1 and an outer hook 2 rotating around a horizontal axis. The basket 1 as well as the outer hook 2 are of well-known construction and will be described but shortly hereinafter.

The basket 1 is essentially comprised of a round bottom 3 provided with round openings 4, and of a wall 5 standing on the bottom, said wall being provided at the end thereof remote from the bottom with a local thickening 6. On the outer surface thereof, the wall 5 is further provided with a rib 7. The bottom 3 of basket 1 lies vertically. The outer hook 2 also comprises a round bottom 8 and a wall 9 standing thereon. Said wall 9 is cut-off locally and forms a driving beak 10 which will take along by the stitching, the upper thread loop formed by the needle and pass said loop over the basket 1. The wall 9 is provided on the inner surface thereof with a groove 11 inside which fits the rib 7 of basket 1. With the thickening 6 thereof, the wall 5 faces the outer edge of wall 9. The basket 1 is retained stationary in a way known per se, by means of a finger (not shown in the drawings) which is made fast to the remaining portion of the sewing machine. The hook 2 is rotated about a horizontal axis by means of a shaft 12 to which the bottom is made fast and which is driven by the motor (not shown in the drawings) of the sewing machine.

The device for unwinding thread comprises a spool formed by a central sleeve 13 and two flanges 14 which are connected to both ends of said sleeve 13. The thread 15 is wound around sleeve 13, between both flanges 14. Said spool 13,14 is further arranged inside a spool case which is in the shape of a small reversed box and has a round bottom 16, a wall 17 standing thereon and a hollow pin 18. The wall 17 is cut-off locally. The hollow pin 18 lies in the centre of the inner surface of bottom 16 and has substantially the same height as said wall 17. Where wall 17 is cut-off, the bottom 16 is provided with a recess 19 which has for its purpose to avoid interfering with the needle point during the stitching. In the centre thereof, the bottom 16 is provided with a round opening 20 which opens on the inner side of the hollow pin 18 and which has the same area as the inner cross-section of said hollow pin. The spool case is slipped with the hollow pin 18 thereof over a round pin 21 which lies in the centre of the basket bottom 3. The end of pin 21 is located inside the opening 20 in spool case bottom 16. The hollow pin 18 fits precisely around the pin 21, while the spool case is also fitted as an unit precisely inside the basket 1. On the outer side of wall 17 of the spool case, facing a recess in the basket wall 5, there has further been made fast a small spring (not shown in the drawings) to give the required tension to thread 15.

The spool case is retained inside basket 1 by means of a small latch. Said latch is comprised essentially of a small oblong plate 22 which is slidingly arranged with the long sides thereof in grooves 28 in the bottom 16 and a small operating plate 23 which is hingedly connected to one end of the small plate 22 and forms a lever which enters with the one end thereof a recess 29 in bottom 16. When the operating plate 23 is swung from the downturned position thereof shown in the drawings, said plate moves away together with the small plate 22 against the action of a spring (not shown). The small plate 22 is further provided with a round opening 24 through which can pass the pin 21. When the operating plate 23 is swung down, the small plate 22 lies in a position where it enters partly a groove 25 which extends over the periphery of the pin 21 passing through opening 24. The operating plate 23 has a rectangular opening 26 inside which enters freely the end of pin 21. When the operating plate 23 is swung from the position shown in the drawings, said small plate 22 also moves in such a way that the opening 24 thereof is then located concentrically relative to pin 21 and thus said small plate does no more enter groove 25, in such a way that the spool case can be removed from the pin 21. The small plate 22 is further provided with a small hook 27 which is used to firmly retain the bobbin through an opening in the spool case, in the upturned position of the small operating plate 23. For the clearness of the figure, part of bottom 16 of the spool case has been broken away in FIG. 1.

From spool 13,14, the thread 15 passes through an opening in wall 17 of the spool case. Said thread coming from the spool upper side, is bent approximately over 180° when the spool is full. The thread then extends upwards, underneath a small braking spring (not shown) on the outer surface of the spool case, through a groove 30 in the thickened edge 6 of basket wall 5 and through the needle hole in the needle plate (not shown) of the sewing machine. By a pull on the thread 15, the spool 13,14 is thus pulled obliquely downwards.

Figure 2:
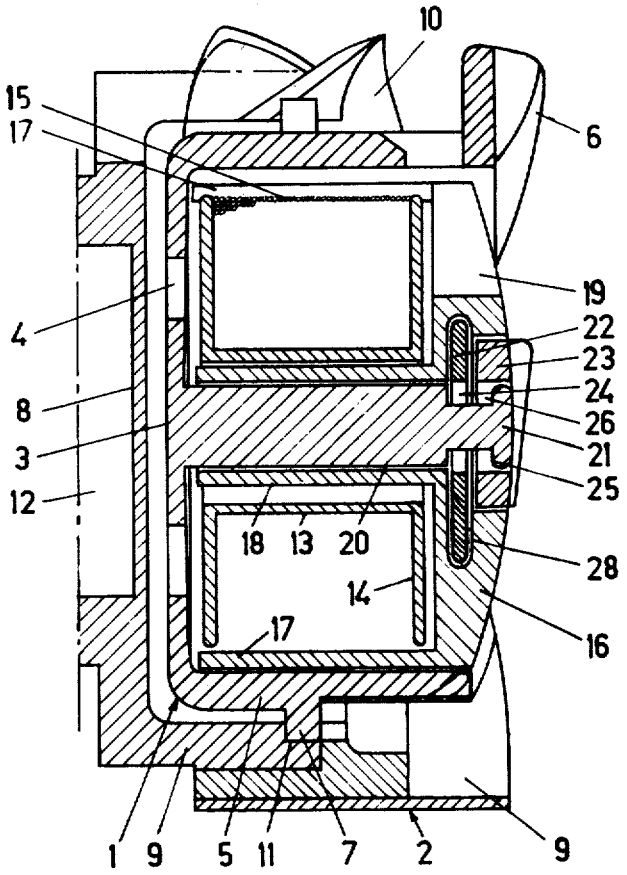
FIG. 2 is a section view along line II—II in FIG. 1.

In the embodiment of the device as shown in FIGS. 1 and 2, the hollow pin 18 has the same circular cross-section over the whole height thereof. The inner cross-section of the sleeve 13 is to the contrary in the shape of a triangle with rounded angles. Said triangle circumscribes a circle the diameter of which is larger by 4 to 15 percent and preferably by 8.5 percent than the diameter of the circular cross-section of hollow pin 18. The sleeve 13 and thus the whole spool 13,14 can move slightly sidewise inside the spool case relative to hollow pin 18. Such displacement of the spool relative to hollow pin 18 is not prevented by the flanges 14 the diameter of which is slightly smaller than the spool case inner diameter. The rounds-off of the inner triangular cross-section of sleeve 13 have a curvature radius which is slightly smaller than the radius of the circular cross-section of hollow pin 18. Said hollow pin 18 can thus connect with the inner surface of sleeve 13 but in two points on the circumference of said sleeve circular cross-section. The outer circumference of sleeve 13 is round, in such a way that the winding and unwinding of thread 15 relative to sleeve 13 occurs as easily as possible.

By the stitching, the thread 15 is retained against the material to be stitched by the upper thread not shown in the drawings. Due to the movement of the material to be stitched, a pull is exerted on the thread 15, in such a way that said thread is thus unwound sidewise from the spool 13,14. Said spool 13,14 rotates consequently about the spool case. The spool 13,14 is then also pulled obliquely downwards until it lies with flanges 14 against the inner surface of spool case wall 17. The spool is shown in such position in the figures. This slight displacement of the spool relative to the hollow pin 18 of the spool case is made possible because the inner opening in sleeve 13 is larger than the outer diameter of the hollow pin 18. The dimensions are also so selected that when the spool engages with the flanges 14 thereof the spool case wall 17, the inner surface of the sleeve 13 lies locally against the outer surface of pin 18. The engagement between said hollow pin 18 and sleeve 13 is also very localized due to the triangular shape of the inner cross-section of the sleeve 13. Due to this constant engagement and mostly due to the spool also bearing on the inner surface of the spool case wall 17, the spool rotation is not impeded by the particular shape of the inner cross-section of sleeve 13.

When the movement of the material to be stitched then stops, the pull on the thread 15 also stops. Due to the reaction when the pulling force disappears and to the difference in shape between the inner cross-section of sleeve 13 and the outer cross-section of hollow pin 18, the spool 13,14 begins directly to swing alternately on hollow pin 18. Due to the impacts between sleeve 13 and hollow pin 18 which are caused thereby, most of the movement energy retained by the spool 13,14 when the pull on thread 15 stops, is spent. As a rule, the spool already stops after a single impact. In any case, the rotation of said spool and thus the further unwinding of thread 15 are stopped almost immediately by said spool impacts. There is thus no danger of the windings of the thread 15 becoming loose.

Figure 3:
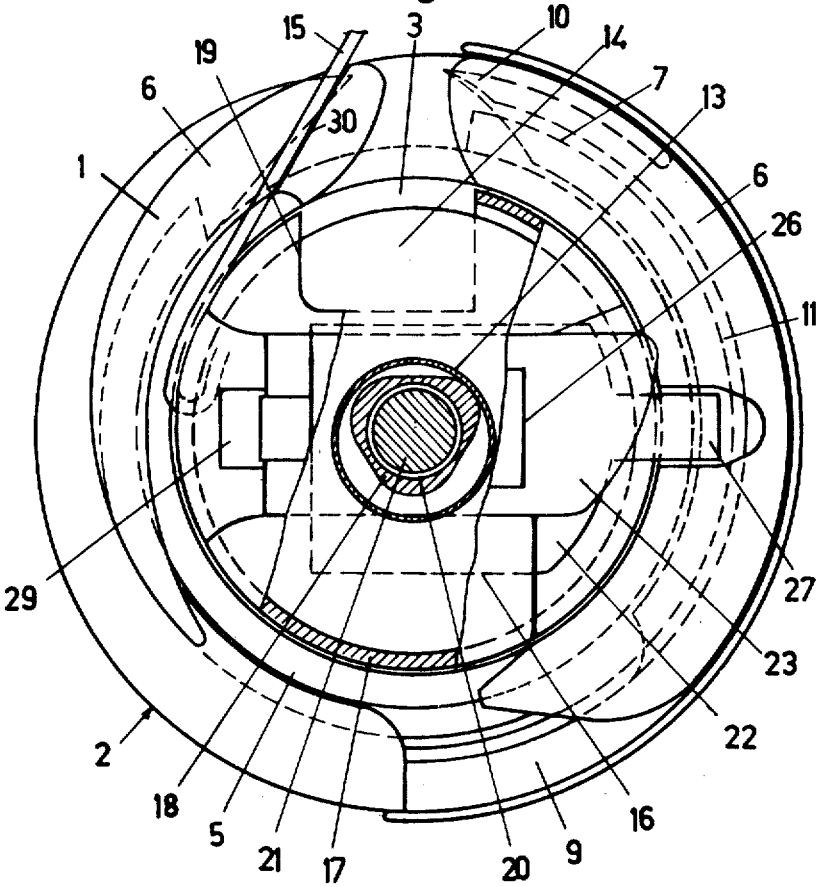
FIG. 3 is a side elevation view similar to FIG. 1, but relating to another embodiment of the device according to the invention.

The embodiment according to FIG. 3 only differs from the embodiment shown in FIGS. 1 and 2 in the inner cross-section of sleeve 13 as considered at right angle to the lengthwise direction thereof, being round while the cross-section of hollow pin 18 also as considered at right angle to the lengthwise direction thereof, is different from a round shape. Indeed the cross-section of hollow pin 18 is in the shape of a triangle with rounded angles that lie inside an imaginary circle. The diameter of the inner circular cross-section of sleeve 13 is larger by 4 to 15 percent and preferably 8.5 percent than the diameter of said circle encircling the rounded-off triangle. In this embodiment also, when the pull on thread 15 stops, a direct swinging of spool 13,14 is obtained relative to hollow pin 18, in such a way that the rotation energy retained in said spool when the pull on the thread stops is immediately spent by one or a plurality of impacts.

Due to the use of the above-described devices for unwinding thread, when the pull on said thread stops, any further thread unwinding due to the further rotation of the spool is avoided. To avoid also that with a full spool 13, 14 the thread of which has not yet been connected to the material to be stitched and which is for instance presented as such for sale, the outer turns of thread 15 come loose, said outer turns can be caused to adhere to one another. Use can be made therefor of glue. When the thread 15 is a thermoplastic monofilament, in which case the danger of loosening or releasing of turns is highest, the outer turns can be stuck to one another by slightly heating said turns. Preferably some pressure is applied to the turns by the heating.

It must be understood that the invention is in no way limited to the above embodiments and that many changes can be brought therein without departing from the scope of the invention as defined by the appended claims.

For instance the spool sleeve does not have necessarily to have a constant cross-section over the whole length thereof. The inner cross-section of the spool sleeve can for example be smaller at both ends thereof than in the intermediate portion. Said ends with smaller cross-section can be formed for instance by a portion bent back towards the spool inner side. Said bent-back portion can lie in the extension of the flanges.

It is not absolutely required either that the spool be provided with two flanges.

The device according to the invention could also not be part of a sewing machine.

I claim:

1. A device for unwinding thread comprisng a bobbin having a sleeve about which the thread is wound and a pin having a circular cross-section upon which the bobbin is rotatably mounted so that withdrawal of the thread will cause rotation of said bobbin around said pin, said sleeve having an internal cross-section of polygonal-shape which polygon is circumscribed about a circle the diameter of which is 4–15 percent greater than the diameter of said pin.

2. A device according to claim 1 wherein said polygon is triangular and the angles thereof are rounded.

3. A device according to claim 2 wherein the circle around which the triangle is circumscribed has a diameter which is 8.5 percent greater than the pin diameter.

4. A device according to claim 2 further comprising a sewing machine having a hook mounted for rotation about the horizontal axis and a spool case disposed within said hook, said pin being formed integral with said spool case for supporting said bobbin within the hook so that the thread thereon is pulled upwardly and sideways relative to the bobbin during unwinding.

* * * * *